United States Patent [19]

Ericsson

[11] 4,414,755

[45] Nov. 15, 1983

[54] DRYING DEVICE INTENDED FOR DRYING MATERIAL BEARING PRINT ISSUING FROM A PRINTING MACHINE

[75] Inventor: Sylve J. D. Ericsson, Tumba, Sweden

[73] Assignee: Svecia Silkscreen Maskiner AB, Norsborg, Sweden

[21] Appl. No.: 307,307

[22] Filed: Sep. 30, 1981

[30] Foreign Application Priority Data

Oct. 1, 1980 [SE] Sweden ..... 8006847

[51] Int. Cl.[3] ..... F26B 21/12

[52] U.S. Cl. ..... 34/4; 34/41; 34/54; 118/58

[58] Field of Search ..... 34/4, 41, 40, 76, 77, 34/54; 118/58, 61

[56] References Cited

U.S. PATENT DOCUMENTS

| | | | |
|---|---|---|---|
| 4,150,495 | 4/1979 | Stern | 34/54 |
| 4,233,901 | 11/1980 | Mallinson | 34/77 |
| 4,336,279 | 6/1982 | Metzger | 34/41 |
| 4,337,582 | 7/1982 | Smith | 34/76 |
| 4,343,096 | 8/1982 | Bergland | 34/77 |

*Primary Examiner*—Larry I. Schwartz

*Attorney, Agent, or Firm*—Burns, Doane, Swecker & Mathis

[57] ABSTRACT

A drying device intended for drying material bearing print issuing from a printing machine consisting of a conveyor (4) for the material and adjacent heat-emitting elements (11). A flow of air (12) is so arranged as to pass over the conveyor (4) for the material, thereby absorbing volatile substances released by the ink on the material during the drying process. The speed of the flow of air (12) is set in relation to the level of volatile substances in a specific quantity of exhaust air (12*a*). The level of volatile substances is monitored continuously by a device (13) which is connected to a measuring instrument (14), the output signal of which controls a motor which adjusts the setting of a throttle valve (17), so that the concentration of volatile substances inside the drying device will be kept at or immediately below a maximum permissible value, thereby achieving considerable savings in energy.

3 Claims, 3 Drawing Figures

DRYING DEVICE INTENDED FOR DRYING MATERIAL BEARING PRINT ISSUING FROM A PRINTING MACHINE

TECHNICAL FIELD

The present invention relates to a drying device and in particular to a drying device of a kind intended for drying material bearing print in the form of printing ink issuing from a printing machine, for instance a screen-printing machine. The drying device consists of a conveyor for the material and possibly driving devices for said conveyor together with adjacent heat-emitting elements, usually in the form of resistance coils heated by an electric current. A flow of air is so arranged as to pass over the conveyor for the material, thereby absorbing volatile substances released by the printing ink during the drying process. It is usual for the flow of air to be generated by a fan located inside the drying device.

The material issuing from the printing machine may be either in continuous form or in the form of separate sheets.

DESCRIPTION OF THE PRIOR ART

Previously disclosed are various types of drying device intended to be connected to a printing machine, for instance a screen-printing machine, and in which material bearing printing ink is fed from the printing machine. This material is then caused to pass through a drying device, usually consisting of one or more drying sections, and it is also usual to cause material which has passed through the drying device to pass through a cooling section.

Drying devices have also been proposed in which the heating sections and the cooling section are combined into a single unit.

DESCRIPTION OF THE PRESENT INVENTION

Technical Problem

A particular technical problem exists with regard to drying devices in general and especially with regard to the aforementioned application, in that such drying devices exhibit extremely high power and energy requirements. The required connection power is consequently high, since it is usual for the drying devices to be operated by electric current. This is attributable mainly to the fact that it is necessary to pass a large volume of air through the heating section in a given unit of time and to raise said volume of air to a high temperature, since the printing ink applied to the material must dry within the period for which the material is being transported through the heating sections by the conveyor.

A troublesome technical problem is posed by the fact that the exhaust air from the heating section cannot be recycled, since this air is charged with volatile substances which must not be re-introduced into the heating sections, since a re-circulating system of this kind would cause volatile substances to accumulate in the heating section resulting on the one hand in a major fire hazard and on the other hand in the risk of poisoning.

The maximum permissible level of volatile substances which may occur in a given volume of air inside the drying device is stipulated in extremely strict regulations.

It is obvious, therefore, that a reduction in this level to one half of its value will immediately require twice the volume of air per unit of time and consequently twice the available energy.

It is also obvious that the entire drying device, and in particular the heating sections, must be designed on the basis of the fundamental principle that they are capable of generating a flow of air at a volume of air per unit of time which is adequate to deal with all the volatile substances produced when the printing machine is printing at full speed using a screen which will enable a large quantity of ink to be applied at each stage of the printing process, at the same time as the output must be sufficiently high to dry even thick layers of printing ink as the material passes through the drying sections. The need to optimize the drying device means that it will normally operate well below its maximum capacity, which may also result in high energy losses. This occurs since the printing speed will be at less than full speed and the layer of printing ink may be thin or have been applied only to small areas.

SOLUTION

The present invention proposes to provide details of a drying device intended to be capable of drying material bearing printing ink issuing from a printing machine, for instance a screen-printing machine. The drying device consisting of a conveyor for the material and adjacent heat-emitting elements together with a flow of air arranged so as to pass over the conveyor for the material, thereby absorbing volatile substances released by the ink on the material during the drying process. The drying device being of such a nature as to be capable of resolving the aforementioned problems, said drying device exhibiting a level of power consumption and energy consumption largely in line with the actual printing speed of the printing machine and with the quantity of printing ink on each item of material intended for printing, so that the level of volatile substances in the exhaust air will remain close to or directly below the specified or desired value.

To this end the present invention offers the possibility of selecting the volume of air per unit of time in the flow of air in relation to the actual level of volatile substances in the exhaust air, so that as the level of volatile substances increases a corresponding adjustment will be made to the flow of air to cause the flow to contain a higher volume of air per unit of time, thereby causing the level of volatile substances to fall.

The present invention thus offers a device for monitoring the levels of volatile substances in a given volume of exhaust air with the device being connected to a measuring device. The measuring device is designed so as to generate an output signal corresponding to the level of volatile substances, or an output signal given as soon as the recorded value exceeds a limit value set on the measuring device.

The output signal thus generated may either be connected in such a way as to control by means of a motor the setting of a throttle valve located in the inlet duct for the flow of air, whereby the throttle valve is closed when the level of volatile substances is low and is opened when the level of volatile substances is high, or the output signal may be connected in such a way as to control by means of a fan motor the volume of air per unit of time, so that the fan is caused to run at a low speed when the level of volatile substances is low and at a high speed when the level of volatile substances is high.

TECHNICAL ADVANTAGES

The technical advantages which may be regarded as being associated with a drying device in accordance with the present invention are that the power consumption and energy consumption of the drying device are controlled directly in relation to the printing speed of the printing machine in conjunction with the quantity of printing ink applied by the printing machine to the item of material intended for printing at each stage of the printing process.

Thus the present invention makes it possible in this way to adjust the energy requirement of the drying device directly to suit the printing speed and the quantity of printing ink by continually permitting the adjustment of the level of volatile substances in relation to a given volume of air at or in the immediate vicinity of, and preferably below, a specific maximum limit value for the ratio between the level of volatile substances in a given volume of air or the concentration of volatile substances.

DESCRIPTION OF THE DRAWINGS

A preferred embodiment exhibiting the significant characteristic features of the present invention will now be described in greater detail with reference to the attached drawing, in which.

DESCRIPTION OF THE PREFERRED EMBODIMENT

Figure 1:
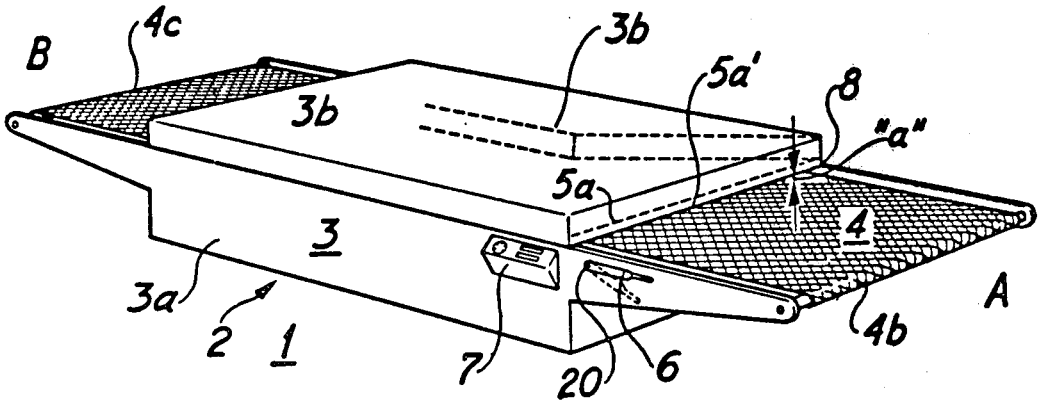
FIG. 1 is a perspective view of a proposed drying device incorporating the significant features which are characteristic of the present invention.

Thus FIG. 1 shows a perspective view of a drying device intended for a printing machine, in particular a screen-printing machine, resting on a base 1. The actual drying device has been given the reference designation 2. The drying device consists of a frame 3 supporting a conveyor which moves in the horizontal plane. The conveyor 4 is intended to transport individual sheets or continuous material bearing printing and printing ink after delivery from a printing machine from position 'A' to a stacking device in position 'B' (not shown). The sheet or material bearing the printing is intended to pass through the drying device 2, thereby drying the printing ink which forms the printing. In order to do this the drying device 2 shown in FIG. 1 is fitted with devices (not shown) for producing heated air. These devices may best be located in the lower part 3*a* of the drying device. The heated air passes through channels (not shown) into the part 3*b* and in said part 3*b* the air is caused to pass through a number of nozzles situated in a plane above the horizontal plane of the conveyor.

Since the printed sheet or material is delivered from the printing machine at a predetermined height it will be necessary for that part of the conveyor 4 identified by the reference designation 4*b* to be positioned at a height suitable to receive the printed sheet or material as it leaves the printing machine. The part 4*b* must therefore be strong. The same requirement may be regarded as being applicable to part 4*c*, which is a delivery extension for the conveyor 4. With regard to FIG. 1, it should be noted that the conveyor 4 is positioned with a clearance 'a' from the part 3*b* and in particular from a plane 5*a* defined by the nozzles within the part 3*b*. Said clearance 'a' must be sufficient to permit the printed material to pass into the drying device, even if the height dimension of the material is considerable. If the clearance 'a' is excessive, then it is clear that major losses will result, since heated air will be able to pass through the clearance or the gap. Consequently, it is highly desirable to be able to adjust the clearance 'a' or the gap in such a way that the printed sheet or material will pass comfortably and evenly beneath the edge 5*a'*.

It is perhaps of particular interest to note that a stacking device located at position 'B' may easily be replaced by a cooling section, and that it is also possible to design the drying device 2 in such a way that the material to be printed will first pass through one or more heating sections, followed by a cooling section, before the material is allowed to pass to a stacking device.

Finally, it may be appreciated from FIG. 1 that the part 3*b* is fitted with a hinged arrangement 8 enabling it to be raised to the position indicated by the dotted line for the purpose of inspecting not only the conveyor but also the nozzles located on the inside of the part 3*b*.

An arm 6 is provided to enable the clearance 'a' to be adjusted by rotating the arm 6 about the pivot point 20, thereby raising or lowering the conveyor 4 within the drying sections.

A control panel has been given the reference designation 7.

Figure 2:
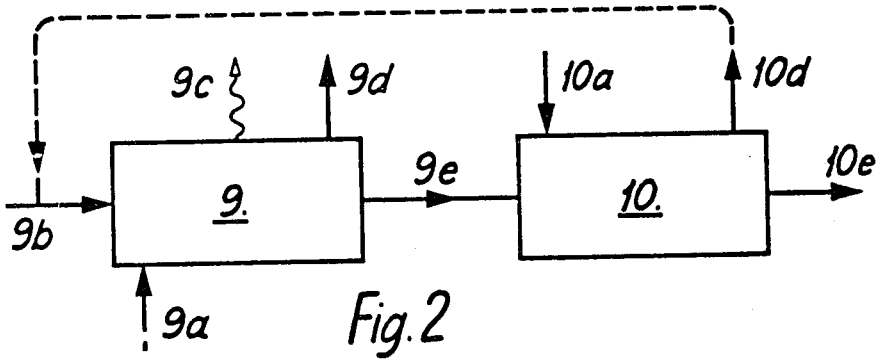
FIG. 2 is a diagrammatic representation of a drying device consisting of a heating section and a cooling section, and in which an actual power distribution including power losses is shown.

FIG. 2 illustrates a drying device consisting of a heating section 9 and a cooling section 10.

An example may be quoted at this point in order to illustrate the distribution of the energy requirement of the drying device. If it is assumed that the arrow 9*a* indicates a power input of 30 kW, then the volume of fresh air arriving in the direction of the arrow 9*b* will be heated by power equivalent to 30 kW. The arrow 9*c* indicates that the heat loss by radiation together with other losses due to the design of the device may be estimated at 4 kW. The reference designation 9*d* indicates that the heated exhaust air has an energy content corresponding to a power of 18 kW. The material passing from the heating section in the direction of the arrow 9*e* to the cooling section contains heat with an energy content corresponding to a power of 8 kW.

Once the material has passed into the cooling section, a quantity of fresh air is introduced as shown by the arrow with the reference designation 10*a*, said quantity of fresh air then cooling the material, as the result of which the exhaust air from the cooling unit as shown by the reference designation 10*d* will have an energy content corresponding to a power of 6 kW, whilst the material which has passed through the cooling section, as shown by the reference designation 10*e*, will contain energy corresponding to a power of 2 kW.

The power requirement of 30 kW may be reduced to about 24 kW by taking into account the thermal energy obtained from the exhaust air 10*d* in the cooling section, since this may be piped in such a way that it will heat the quantity of air introduced via the fresh air intake to the heating section, as indicated by the reference designation 9b.

It should be noted at this point that the aforementioned drying device of optimum dimensions suffers from major losses, and that a drying device which is operated without drying printed material produced by a printing machine will exhibit a power requirement reduced by only 8 kW.

Consequently, it is highly desirable to be able to manufacture a drying device such that the power requirement may be adapted to suit the printing speed of the printing machine on the one hand and on the other hand the quantity of printing ink applied to the material in relation to the desired levels of volatile substances in the exhaust air from the drying sections.

The present invention is based on the requirement to be able continuously to adjust the level of volatile substances in relation to a given quantity of air, so that the ratio between the volatile substance and the quantity of air will remain within or below predetermined limits or limits which have been stipulated by the authorities.

Figure 3:
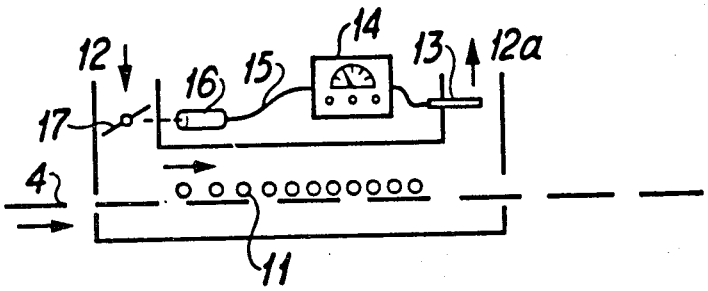
FIG. 3 is a basic operating diagram for a connecting device used in accordance with the present invention for the purpose of being able to adjust the level of volatile substances in the volume of exhaust air, and which also illustrates how a sensing device is connected to a control apparatus enabling the proportion of volatile substances in a given volume of air to be controlled and maintained at a predetermined value.

FIG. 3 shows a diagrammatic representation of a wiring circuit which will permit such adjustment to be made. FIG. 3 contains a diagram of a drying device intended to dry printed material issuing from a printing machine, for instance a screen-printing machine, said drying device consisting of a conveyor 4 for the material together with adjacent, heat-emitting elements 11. The flow of air 12 is so arranged as to pass over the conveyor for the material, whereby the flow of air absorbs volatile substances released by the ink on the material during the drying process, so that the exhaust air flow 12a will be charged with volatile substances.

The present invention now offers the possibility of regulating the speed or intensity of the air flow and of selecting the air flow in relation to the level of volatile substances in the quantity of exhaust air 12a. This means that the presence of high levels of volatile substances in the exhaust air 12a will be able to cause and regulate the introduction of a larger quantity of air per unit of time. This will be done by the continuous monitoring by a device 13 of the level of volatile substances in the exhaust air 12a. Said device 13 is connected to a measuring device 14, so arranged as to generate in the wire 15 an output signal corresponding to the level of volatile substances.

FIG. 3 shows this output signal to be connected in such a way as to control via a motor 16 the setting of a throttle valve 17 located in the intake duct for the air 12.

The output signal may, of course, be connected in such a way as to control the quantity of air per unit of time by means of a thyristor-controlled fan motor, by regulating the speed at which the fan motor rotates.

This arrangement will produce a considerable saving in energy in a drying device, although the level of volatile substances in relation to a given quantity of air inside the drying device will still not exceed the approved limit values.

An example of a suitable sensing device is the MSA Remote Head Gas Alarm Model RH4 manufactured by the Mine Safety Appliances Company Limited.

An example of a suitable measuring device is the controlled-output measuring device manufactured by the Mine Safety Appliances Company Limited.

As far as the measuring device 14 is concerned, it may be advisable to select a device in which it is possible to adjust the desired limit value for the level of volatile substances per given quantity of air. In the event of the recorded value falling below the set value, the fan may be switched off or may rotate at a low speed, or alternatively the throttle valve 17 may be closed.

Once the level of volatile substances rises above the set value, the speed of the fan may be increased or the valve may be opened. It may be advisable to relate the increase in the speed of the fan to the rate of increase in the level of volatile substances, so that a high rate of increase will cause the fan to rotate more rapidly than a low rate of increase.

The present invention is not restricted to the preferred embodiment indicated above by way of an example, but may undergo modifications within the scope of the idea of invention.

Especially it should be noted that the basic conscept is to have a first air stream circulation inside the drying device and in this air stream the level of volatile substances is checked. When exceeding this level a second air stream (without volatile substances) will be mixed to the first air stream and the overflow air stream is evacuated.

I claim:

1. A drying device intended for drying material bearing print issuing from a printing machine such as a screen-printing machine, comprising a conveyor for the material and heat-emitting elements arranged adjacent the conveyor, means for establishing a flow of air to pass over the conveyor for the material from an inlet duct to an exhaust duct thereby absorbing volatile substances released by the ink on the material during the drying process, a device for sensing the levels of volatile substances in a given quantity of exhaust air in the exhaust duct, said device being connected to a measuring apparatus for generating an output signal corresponding to the level of volatile substances or for generating an output signal when the level of volatile substances exceeds a predetermined value, an increased proportion of volatile substances in the exhaust air causing a control device to be activated by the output signal to allow a greater quantity of air per unit of time to pass from the inlet duct to the exhaust duct, said output signal being connected for controlling one of a motor for setting a throttle valve located in the inlet duct or a fan motor for regulating the quantity of air per unit of time.

2. The device in accordance with claim 1, wherein the levels of volatile substances in the exhaust air are monitored continuously.

3. The device in accordance with claim 1, further comprising a cooling section supplied with air for cooling the material, exhaust air from said cooling section being supplied to the inlet duct.

* * * * *